US005720626A

United States Patent [19]

Dobbelaere et al.

[11] Patent Number: 5,720,626

[45] Date of Patent: Feb. 24, 1998

[54] CONTACT SPRING

[75] Inventors: Joris Dobbelaere, Beernem, Belgium; Artur Wohlfart, Bad Durkheim, Germany

[73] Assignee: Siemens Aktiengesellschaft, Munich, Germany

[21] Appl. No.: 631,823

[22] Filed: Apr. 10, 1996

[30] Foreign Application Priority Data

Apr. 10, 1995 [DE] Germany ..... 295 06 206 U

[51] Int. Cl.[6] ..... H01R 4/24

[52] U.S. Cl. ..... 439/397; 439/843; 439/752

[58] Field of Search ..... 439/397, 396, 439/395, 399, 400, 389, 422, 843, 850, 851, 852, 856, 857, 845, 846, 849, 733.1, 752

[56] References Cited

U.S. PATENT DOCUMENTS

| | | | |
|---|---|---|---|
| 4,269,468 | 5/1981 | Ammon et al. | 439/733.1 |
| 4,410,222 | 10/1983 | Enomoto et al. | 439/399 |
| 4,439,001 | 3/1984 | Curley et al. | 439/733.1 |
| 5,558,547 | 9/1996 | Breitschaft et al. | 439/856 |

FOREIGN PATENT DOCUMENTS

| | | |
|---|---|---|
| 8502106 U | 5/1985 | Germany . |
| 3248078 | 3/1986 | Germany . |
| 3546762 | 1/1991 | Germany . |

*Primary Examiner*—Gary F. Paumen
*Assistant Examiner*—Tho D. Ta
*Attorney, Agent, or Firm*—Herbert L. Lerner; Laurence A. Greenberg

[57] ABSTRACT

A contact spring has a bottom spring having a spring arm base with a bottom wall and two side walls, a terminal part for an electrical conductor projecting integrally from a first end of the spring arm base, and spring arms projecting from a second end of the spring arm base in an extension of the side walls. A detent device is provided for primary locking of the contact spring inside a housing. The terminal part has a bottom wall and two side walls extending away from the bottom wall. Each of the side walls of the terminal part has an end face which is embodied as an insulation piercing connecting device. The spring arm base and/or the terminal part define a stop edge extending orthogonally to an insertion direction of the contact spring.

13 Claims, 3 Drawing Sheets

CONTACT SPRING

BACKGROUND OF THE INVENTION

1. Field of the Invention

The invention relates to contact springs for electrical connectors. More specifically, the invention relates to a contact spring with a bottom spring, which has a spring arm base with a bottom wall and two side walls; a terminal part for an electrical conductor extends integrally from one end of the spring arm base and spring arms extend away from the other end in an extension of the side walls; and a detent device for primary locking of the contact spring inside a housing.

2. Description of the Related Art

Contact springs of this type are described in the prior art, for instance in German Utility Model DE-GM 85 02 106 and in German Patent 35 46 762. Such contact springs are widely used for instance as plug connectors in automotive engineering. In those contact springs, the top spring essentially has the function of increasing the spring force of the contact spring, and with its one or more detent tongues, of enabling a releaseable locking of the contact spring in a contact chamber of a housing made of insulating material. As a rule, the top spring comprises a material with good spring characteristics, while the bottom spring is made from a material with good electrical and thermal properties. By way of example, the top spring can be made as a stamped and bent part from sheet metal. The bottom spring is preferably likewise a stamped and bent part, but because of the necessarily good electrical properties it is preferably made of spring bronze.

Another contact spring is known from German Patent 32 48 078. In that contact spring, the terminal part for an electrical conductor comprises a crimp connection with an insulating claw and a conductor claw that are clamped to an electrical conductor or to its grounding terminal.

In automotive engineering it is often desirable to embody the terminal part as an insulation displacement connection (IDC), so as to avoid the process of bending over the terminal part of the contact spring that is necessary for the crimped connection on the one hand and on the other to obviate removing insulation from the electrical conductor to be connected. In an insulation displacement connection, the electrical line that is to be connected in fact needs merely to be pressed between the insulation piercing connecting devices. As the electrical line together with its insulating sheathing is pressed into the insulation piercing connecting device, the insulation piercing connecting device cuts through the insulating sheathing, so that the electric conductor in this supply line comes to rest at the insulation piercing connecting devices made of electrically conductive material. However, it is problematic to provide contact springs with such insulation displacement connection members, because the contact forces that arise when the line to be connected is pressed into the insulation piercing connecting devices or terminal part of such contact springs typically do not meet adequate support surfaces. As a result, the contact to be made with the contact spring may be endangered. Moreover, the connection between the insertion region and the insulation piercing connecting device region has not been sufficiently stable in the prior art.

SUMMARY OF THE INVENTION

It is accordingly an object of the invention to provide a contact spring, which overcomes the above-mentioned disadvantages of the heretofore-known devices and methods of this general type and which has an insulation displacement connection, which assures a satisfactory electrical and mechanical connection between the contact part and the terminal part. It is also an object to assure that the stop forces, when the electrical lines to be connected are installed, can be transmitted adequately to a housing of the contact spring.

With the foregoing and other objects in view there is provided, in accordance with the invention, a contact spring assembly, comprising:

a contact spring defining a given insertion direction, the contact spring including:

a bottom spring having a spring arm base with a bottom wall and two side walls, a terminal part for an electrical conductor projecting integrally from a first end of the spring arm base, and spring arms projecting from a second end of the spring arm base in an extension of the side walls; and a detent device for primary locking of the contact spring inside a housing;

the terminal part having a bottom wall and two side walls extending away from the bottom wall, each of the side walls of the terminal part having an end face embodied as an insulation piercing connecting device;

at least one of the spring arm base and the terminal part defining a stop edge extending orthogonally to an insertion direction of the contact spring.

In other words, the invention resides in embodying the terminal part of the contact spring as a double insulation piercing connecting device, and providing stop edges on the spring arm base of the bottom spring and/or the side walls of the double insulation piercing connecting device that on insertion of the contact spring into a housing strikes support faces provided there. The terminal part has a bottom wall and two side walls extending away from the bottom wall that are each embodied on their face end as insulation piercing connecting devices.

In accordance with an added feature of the invention, the preferably U-shaped spring arm base and the preferably U-shaped terminal part are rotated by 90° from one another with respect to their U-shaped configuration, in such a way that the bottom wall of the terminal part is embodied as an extension of a side wall of the spring arm base, and one of the two side walls of the terminal part is embodied as an extension of the bottom wall of the spring arm base.

Because of the flat embodiment of the bottom wall of the terminal part with a side wall of the spring arm base and a side wall of the terminal part with the bottom wall of the spring arm base and thus with binding, of L-shaped cross section, of the terminal part to the spring arm base of the contact spring, a very stable contact spring is provided. At the same time, because of the large electrical conducting surface, has an adequately low forward resistance.

Instead of angularly offsetting the spring arm base and terminal part by 90° relative to one another, they may also be oriented in the same way with respect to their U-shaped cross-section. The result is an especially simple, mechanically stable contact spring and the manufacture of such a spring is also substantially simpler.

In accordance with an additional feature of the invention, at least one of the side walls of the spring arm base is approximately L-shaped and this side wall has a greater height toward the terminal part than in the remaining region of the spring arm base. The raised portion of this side wall is provided with a tab, acting as a stop, which extends orthogonally away from this side wall in the direction toward the respectively other side wall. As a result, a support face on the spring arm base is furnished, which if stop forces occur in the consequence of pressing the electrical lines that are to be connected against the double insulation piercing connecting device can strike against an associated plastic housing of the contact spring. Thus the stop forces can be effectively absorbed by the contact spring housing, instead of allowing the force to act on and threaten the contact region of the contact spring.

In accordance with a further feature of the invention, the side wall of the spring arm base, in the region of the raised portion, is approximately 1.2 to 2 times higher than in the remaining portions of the side walls.

To enable effectively supporting the stop forces on mounting of the electrical line on the double insulation piercing connecting device, preferably both side walls are L-shaped and are provided with raised portions, to each of which bent-over tabs are bound. The tabs bent onto one another extend to approximately the middle of the spring arm base and have surfaces that preferably extend flush with one another. The provision of tabs on both side walls of the spring arm base offers the advantage that reliable stopping on the housing of a contact spring is possible even if one of these tabs should have broken off for whatever reason.

In another feature of the invention, at least one of the side walls of the terminal part is provided on its free edge with a tab, likewise acting as a stop, which preferably extends orthogonally away from this side wall in the direction toward the other side wall. Preferably, both side walls are provided with such tabs, which are aimed toward one another. These tabs in the terminal part likewise act as a support face in the event of stop forces. Care must merely be provided that these tabs can be braced on a suitable recess of the housing belonging to the contact spring.

Preferably, the bottom spring of the contact spring is provided with such tabs both at the spring arm base and at the terminal part, so that the forces occurring when the electrical line cable is mounted on the double insulation piercing connecting device of the terminal part of the contact spring assembly can be intercepted and absorbed multiple times in the associated housing of the contact spring. This is possible when the tabs engage suitable support faces formed on the contact spring housing.

In accordance with again another feature of the invention, the above-noted detent device for primary locking of the contact spring is a top spring, fitted over the bottom spring at least at the spring arm base and retained on the spring arm base. The top spring is provided with one or more detent tongues for primary locking. As a result of the separation of the bottom spring and the top spring, it is possible to make the parts of the contact spring that are necessary for the electrical connection from one material, while the top spring responsible for the primary locking can be made from a material having good spring properties. However, it is not compulsory for the primary locking to be achieved by means of a top spring fitted separately over the bottom spring. For instance, one or both side walls of the spring arm base itself may be formed with a detent tongue, which serves the purpose of primary locking of the contact spring.

In accordance with yet another further feature of the invention, the housing of the contact spring, in the region of the side walls of the terminal part which form the insulation piercing connecting devices, is provided with wall segments which support the side walls with the exception of the insulation piercing connecting devices. As a result, when the contact springs are mounted in the associated housing, and in particular in housings embodied as multiple-row flat conductor plugs, the insulation piercing connecting device zones of the contact springs can be kept within the grid. As a result, the required air and creep paths between the various terminal parts of the contact springs can be adhered to as well.

In accordance with a concomitant and particularly preferred embodiment of the invention, many such contact springs are disposed such that they form a multiple-row flat conductor plug with a bush contact in which the cable outlet is at right angles to the insertion direction. To that end, a plurality of contact springs according to the invention are located side by side lo within a housing and in at least two rows one above the other. Where there are two rows of contact springs located directly one above the other, the contact springs of one row are rotated 180° from one another as compared with the other row. The bottom walls of the spring arm bases of the contact springs of one row thus face the bottom walls of the contact springs of the other row. As a result, multiple-row flat conductor plugs can be made that permit a grid of 2.54 mm×2.54 mm in the insertion region, and in the terminal region, with a two-row design, a grid of 1.27 mm.

Other features which are considered as characteristic for the invention are set forth in the appended claims.

Although the invention is illustrated and described herein as embodied in contact spring, is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 4:
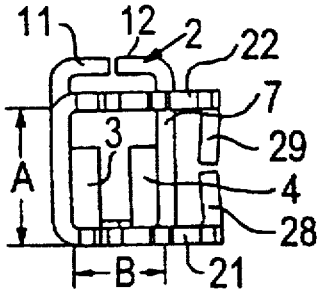
FIG. 4 is a plan end view of a terminal part of the bottom spring of FIGS. 1–3.
Figure 1:
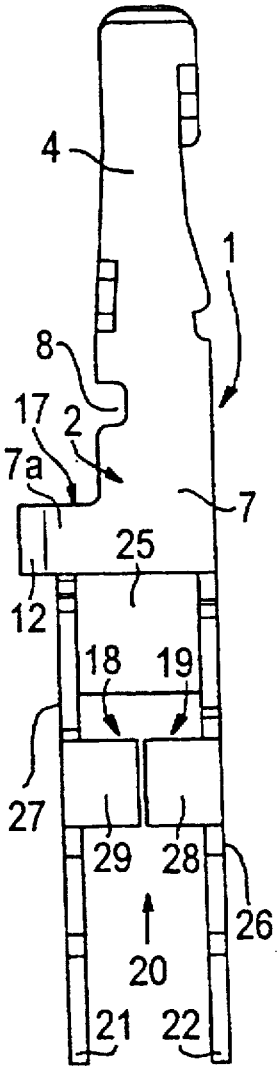
FIG. 1 is a side elevational view of an exemplary bottom spring of a contact spring assembly according to the invention.

Referring now to the figures of the drawing and first, particularly, to FIGS. 1–4 thereof, a bottom spring 1 of the contact spring has a spring arm base 2 approximately centrally along its longitudinal axis X. Two spring arms 3 and 4 are integrally formed on a front end of the spring arm base 2. A terminal part 20 is integrally formed on to a rear end of the spring arm base 2. The spring arm base 2, which in this exemplary embodiment is bent (at least approximately) in a U, has a bottom wall 5. L-shaped side walls 6, 7 extend away from the bottom wall 5 parallel to a longitudinal axis X. The side walls 6, 7 of the spring arm base merge with the two spring arms 3 and 4 in the insertion region of the bottom spring 1. The two spring arms 3, 4 first extend toward one another in the direction of a contact zone 9, and then diverge again in funnel-like fashion, so that an associated flat or round plug can readily enter the contact zone 9 of the two spring arms 3 and 4.

Figure 2:
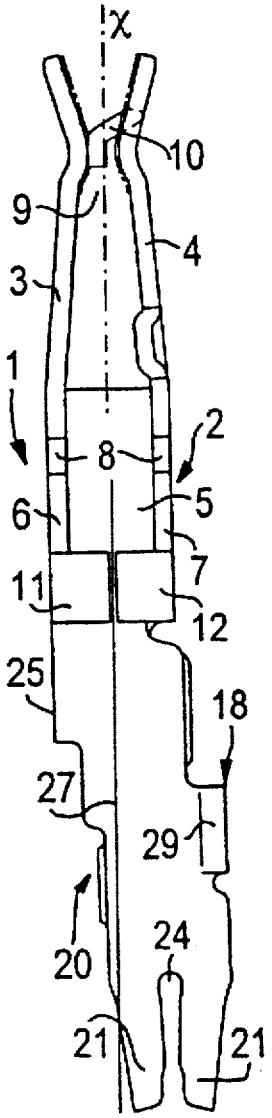
FIG. 2 is a front elevational view of the bottom spring showing the end faces of the side walls.
Figure 3:
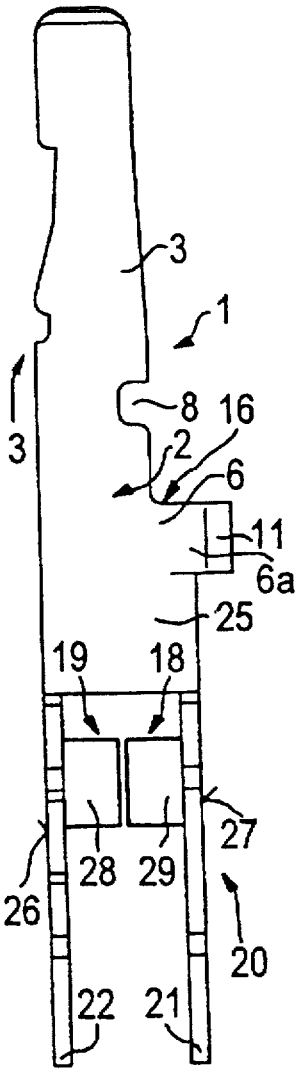
FIG. 3 is a view similar to FIG. 1 showing the opposite side thereof.

With particular reference to FIG. 2, the spring arm 4 is provided in the region of the contact zone with a tab 10, as a spring preopening contour, that is torn out in the direction towards the other arm 3. As is particularly apparent from FIG. 2, the two side walls 6, 7 of the spring arm base 2 are formed, on the free long side facing toward the observer (out of the paper plane), with a recess 8 for fixing thereon a top spring to be described hereinafter. Moreover, the side walls 6, 7 are each raised on their side toward the terminal part 20, so that in plan view the side walls 6, 7 are L-shaped. The raised portions of the side walls 6, 7 are marked 6*a* and 7*a* in the views of FIGS. 1 and 3. The raised portions 6*a* and 7*a* are rectangular. The raised portions 6*a* and 7*a* of the side walls 6 and 7 are bent over, pointing orthogonally toward one another, at their respective free ends with respect to the side walls 6, 7. As clearly shown particularly in FIGS. 2 and 4, the tabs 11, 12 bent over orthogonally to the respective side walls 6, 7 are embodied such that their face ends are opposite one another and thus their surfaces extend flush with one another. This embodiment is not absolutely necessary, however. The tabs 11, 12 may also be oblique to one another. All that is essential is that as a result of the L-shaped embodiments of the side walls 6, 7 a stop is created which can meet in a corresponding part of the housing into which the contact spring is inserted. The stop edges of the side walls 6, 7 are marked 16 and 17 in FIGS. 1 and 3.

As can also be seen from the views of FIGS. 1–4, the terminal part 20 integrally bound to the spring arm base 2 is also U-shaped in this exemplary embodiment. The U-shaped terminal part 20, however, is rotated by 90° about the longitudinal axis X relative to the spring arm base 2. The terminal part 20 has a bottom wall 25, which follows without kinks and flush directly adjacent the side wall 6 of the spring arm base 2. Extending from the bottom wall 25 of the terminal part 20 are two mutually parallel side walls 26, 27. One of the two side walls 26 and 27, in this case the side wall 26, adjoins the bottom wall 5 of the spring arm base 2 without a kink and in a flush manner. In the exemplary embodiment of FIGS. 1–4, the side walls 26, 27 are markedly longer than the bottom wall 25, and on the face end they each terminate as insulation piercing connecting devices 21 and 22. Each of the insulation piercing connecting devices 21, 22 has two insulation piercing connecting device parts, separated from one another by a slit 24.

In order to attach an electrical line to this terminal part 20 of the bottom spring 1, the electrical line, provided with insulation, is pressed into the slit 24. The two opposed insulation piercing connecting device parts 21, 22, on being pressed into this electrical line, cut the insulating sheathing open far enough that the metal line located beneath comes into contact with the insulation piercing connecting device parts 21.

As the electrical wire is pressed into the insulation piercing connecting device, relatively high forces arise, which act axially in the direction of the plug contact. These forces can be absorbed by the stop edges 16, 17 formed in the side walls 6, 7 of the spring arm base 2.

In a further feature of the invention, the terminal part 20 is likewise provided with suitable stop edges 18, 19. To that end, the side walls 26, 27 of the terminal part 20 are provided, over half their height along the longitudinal axis X, with tabs 28, 29 bent over toward one another and each preferably being orthogonal to the respective side wall 26, 27. As shown particularly in FIGS. 2 and 4, the tabs 28, 29 protrude in the direction of the spring arms 3, 4, in comparison with the remainder of the bottom spring 1. When the bottom spring 1 is inserted into the associated housing, the stop edges 18, 19 can thus also engage corresponding support faces of the housing, and when the electrical lines are pressed into the insulation piercing connecting devices of the terminal part 20 they can strike the support faces, so that the resultant stop forces are reliably intercepted and absorbed.

As can also be seen from FIGS. 1–4, the tabs 28, 29 which are bent over onto one another are each long enough so that their face ends face one another and the two tabs 28, 29 are approximately flush at their surfaces.

As the end view of FIG. 4 on the face end of the terminal part of the contact spring shows in particular, the tabs 11, 12 of the spring arm base 2 protrude past both the side wall 6, 7 of the spring arm base 2 and pass the side wall 27 of the terminal part. The tabs 28, 29 of the terminal part 20 that act as a stop likewise protrude past the side wall 7 of the spring arm base 2. The L-shaped integral integration of the terminal part 20 to the spring arm base 2 of the bottom spring 1 is also apparent from FIG. 4. The integrally bound-together portions are marked A and B in FIG. 4.

Figure 5:
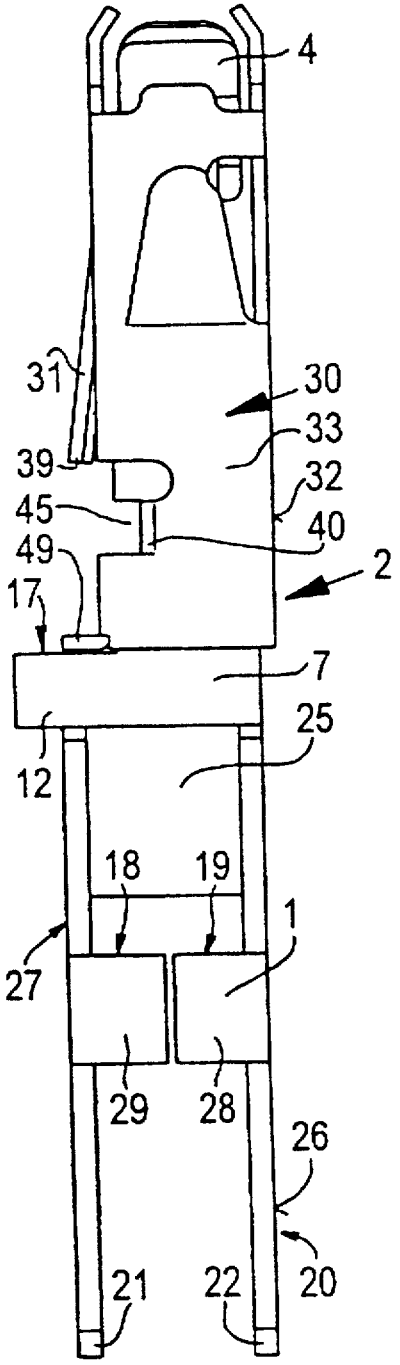
FIG. 5 is a side elevational, slightly enlarged view of the bottom spring of FIGS. 1–4, with a top spring fitted over it.
Figure 6:
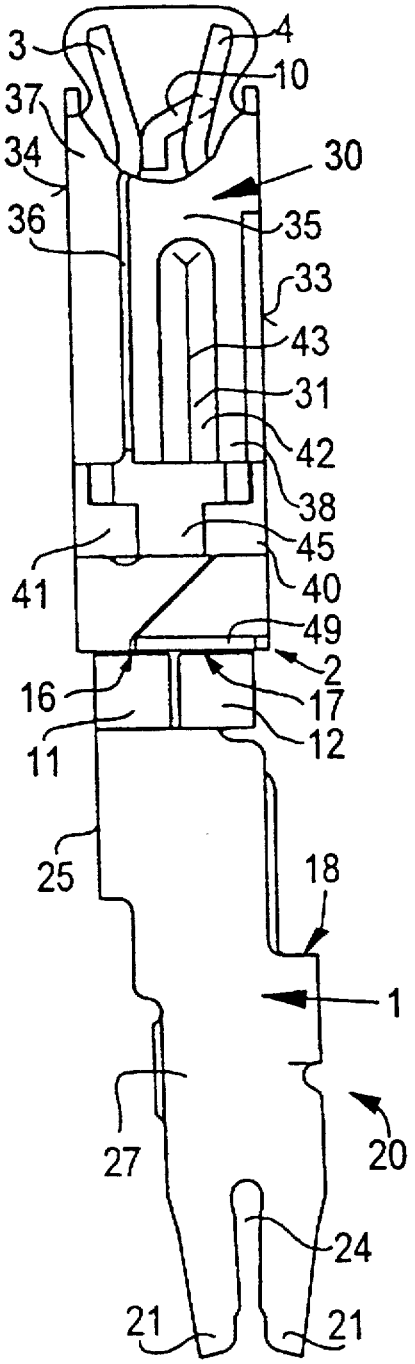
FIG. 6 is a front elevational view thereof.

With reference to FIGS. 5 and 6, the bottom spring 1 illustrated in FIGS. 1–4 has a so-called top spring 30, also known as a detent sleeve or detent spring, fitted over it. The top spring 30 is seated clampingly on the spring arm base 2 of the bottom spring 1.

The top spring 30 is made of sheet metal as a stamped and bent part and is shaped into a part of rectangular cross section, with a bottom part 32, two side parts 33, 34, and a top part 35; for manufacturing reasons, the latter part is split by a lengthwise slit 36. The lengthwise slit 36 of the top part 35 extends eccentrically relative to its width, in the exemplary embodiment of FIGS. 5 and 6, so that the top part 35 is divided into a narrow portion 37 and a wide portion 38. In the exemplary embodiment shown, the wide portion 38 is approximately twice as wide as the narrow portion 37. A detent tongue 31 is cut, extending longitudinally of the top spring 30, into the wide portion 38 of the top part 35. The detent tongue serves to lock the unit comprising the bottom spring and the top spring in a contact chamber of an associated housing and is cut out from the wide portion 38 and—as can be seen from FIG. 5—bent outward at the bending line 43. The detent tongue 31 is formed with an inwardly indented bead 42, which begins somewhat below the bending line 43 and extends centrally, in the longitudinal direction of the detent tongue 31, as far as the free end 39 thereof.

For fixing the top spring 30 on the bottom spring 1, the top part 35 of the top spring 30, in a small region near the terminal part 20 of the bottom spring 1, which region is associated with the spring arm base 2 of the bottom spring 1, has a free cut 45 extending over the entire width of the top part 31. This free cut divides the top part 35 into a protection zone that in boxlike fashion surrounds the spring arms 3, 4 of the bottom spring 1, and a bearing zone, which in boxlike fashion brackets the spring arm base 2. The bearing zone, again for apparent manufacturing reasons, is slit. A narrow rib 49 is provided on the end of the bearing zone toward the terminal part 20 of the bottom spring 1. The narrow rib 49 is bent approximately 90° outward and assures positionally correct insertion of the unit comprising the bottom spring and the top spring into a contact chamber of a housing.

In addition, the side parts 33, 34 of the top spring 30 are provided with inwardly bent retaining tabs 40, 41, which after being bent away from the side parts 33, 34 engage the recesses 8 in the spring arm base 2 that have been mentioned in conjunction with FIGS. 1–4, and as a result assure fixation of the top spring 30 on the spring arm base 2 of the bottom spring 1.

An essential feature of the present embodiment of the contact spring is that the stop edges 16, 17 of the spring arm base 2 and the stop edges 18, 19 of the terminal part 20 protrude past the outer dimensions of the top spring 30, so that on insertion of the contact spring into an associated opening of a housing they can strike support faces provided there.

Figure 8:
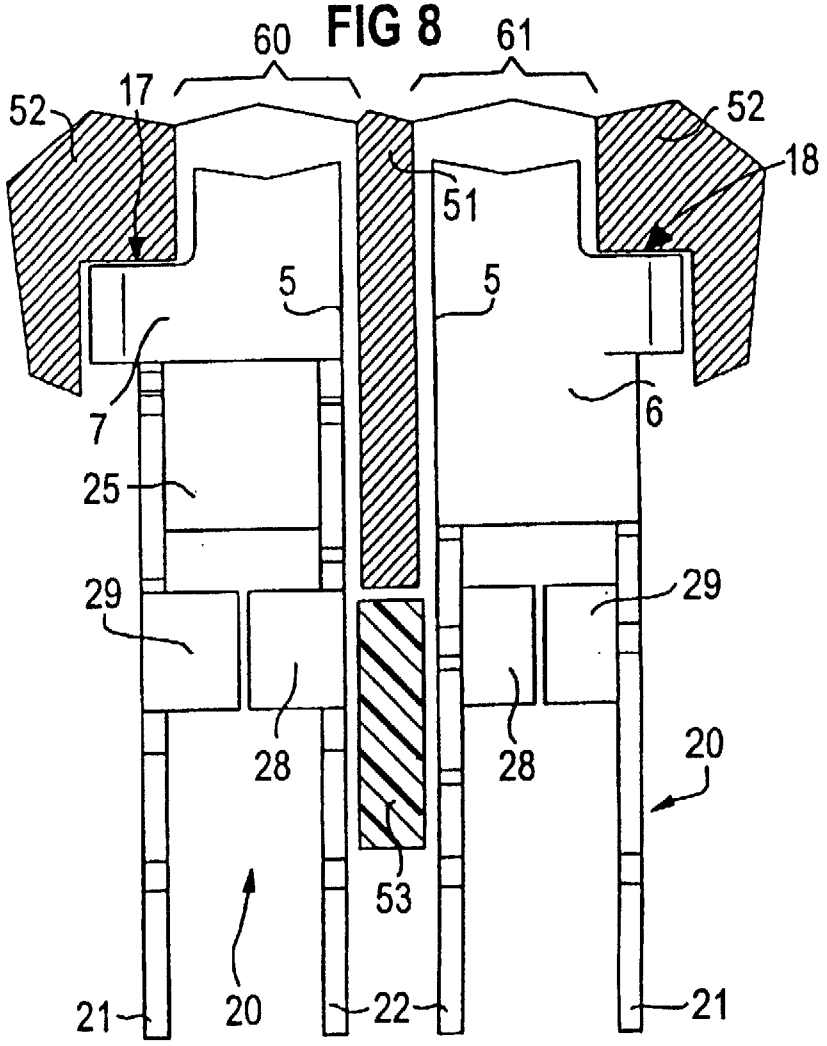
FIG. 8 is a side view of the assembly of FIG. 7.
Figure 7:
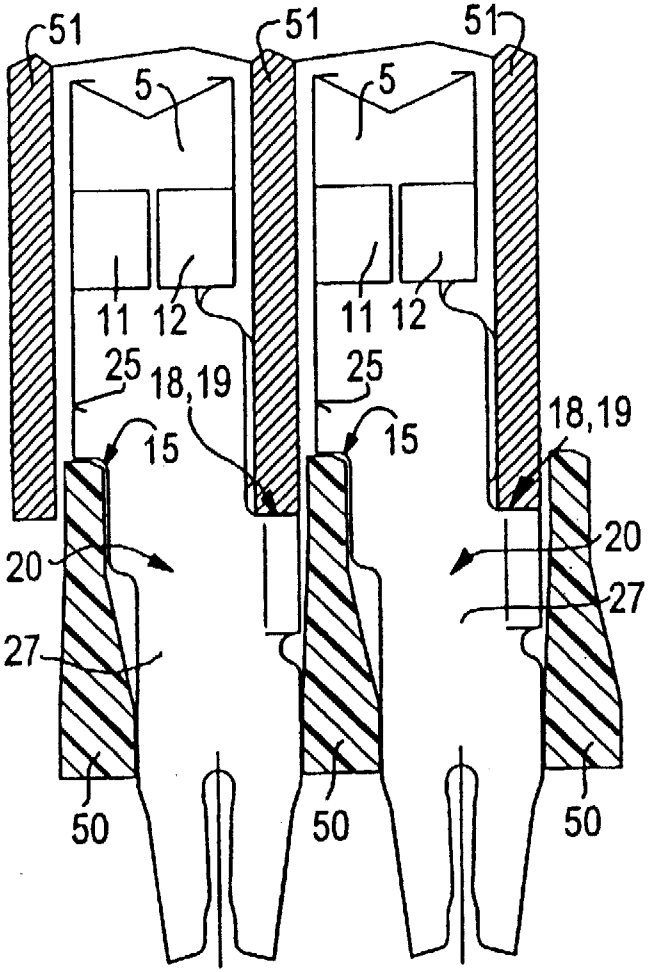
FIG. 7 is a fragementary, partly sectional, front elevational view of two mutually adjacent contact springs of FIGS. 1–6 within a housing.

The contact springs shown in FIGS. 1-6 are suitable in particular for installation in multiple-row flat conductor plug housings with bush contacts, in which the cable outlet is at right angles to the insertion direction of the contact spring. FIGS. 7 and 8 in fragmentary form show how the contact spring of the invention can be integrated, in a space-saving manner, in associated housing openings.

In FIG. 7, two contact springs of the invention are disposed side by side. The bottom walls of the spring arm bases 2 are thereby located adjacent one another in the same plane. Between the two contact springs shown, wall segments 51 of an associated flat conductor plug housing are shown in part. The wall segments 51 strike the stop edges 18, 19 of the terminal parts 20 of the contact springs. Further wall segments 50 are also provided between the contact springs and strike a further stop edge 15 of the terminal part 20 on the face end. The stop edge 15 is defined by the fact that the side walls 26, 27 of the terminal part 20 spring back in L-shaped fashion at the end of the bottom wall 25 at their edges facing the tabs 28, 29. The wall segments 50 strike the L-shaped protrusion, and as a result a stop is formed, upon a tensile strain on the contact spring, or in other words an exertion of force from the insertion side in the direction of the terminal part 20. Accordingly, the contact spring cannot be pulled out of the respective housing opening. The wall segments 50, preferably in the form of movable plastic parts that serve the purpose of secondary securing of the contact springs, are inserted into the corresponding housings.

When there are many contact springs disposed side by side as in FIG. 7, a multiple-row flat conductor plug with bush contacts can be made, which has an insertion region in a grid of 2.54 mm×2.54 mm (1 in×1 in).

In FIG. 8, two contact springs one above the other are shown which, given a two-row layout, permit a grid of 1.27 mm in the terminal region. To that end, two rows 60, 61 of contact springs directly one above the other are provided, in which contact springs of the one row 60 are rotated by 180° relative to the other row, specifically in such a way that the bottom walls 5 of the spring arm bases 2 of the contact faces of one row 60 face the bottom walls 5 of the contact springs of the other row 61.

As seen in FIG. 8, the two rows 60, 61 of contact springs are separate from adjacent wall segments 51, 53. L-shaped wall segments 52 of the associated housing rest on the stop edges 17, 18 of the respective contact springs of these rows 60, 61 of contact springs. As a result, the stop forces that arise, both when the contact springs are inserted into the corresponding openings of the housing and when the lines to be connected are pressed into the insulation piercing connecting devices of the terminal parts 20 of these contact springs, are effectively absorbed.

With the contact springs of the invention it is thus possible in a simple way to provide a multiple-row flat conductor plug with bush contacts, in which the cable outlet is at right angles to the insertion direction, the bush contacts being embodied as double insulation displacement connections. The incident stop forces are reliably transmitted to the housing, since adequate support surfaces can be provided inside the housing that can engage associated stop edges of the contact springs. The connection between the insertion region and the insulation piercing connecting device region is distinguished in the present invention of the contact springs by an extremely stable construction.

We claim:

1. A contact spring assembly, comprising:

a contact spring defining a given insertion direction, said contact spring including:

a bottom spring having a U-shaped spring arm base with a bottom wall and two side walls, a substantially U-shaped terminal part for an electrical conductor projecting integrally from a first end of said spring arm base, and spring arms projecting from a second end of said spring arm base in an extension of said side walls;

a detent device for primary locking of said contact spring inside a housing;

said terminal part having a bottom wall and two side walls extending away from said bottom wall, each of said side walls of said terminal part having an end face embodied as an insulation piercing connecting device;

said spring arm base and said terminal a part being angularly offset by 90° from one another with respect to said U-shaped cross-sections forming an L-shaped;

a tab formed on at least one of said side walls of said spring arm base, said tab extending orthogonally away from said at least one of said side walls in a direction toward the other side wall of said spring arm base, and said tab defining a stop edge; and a tab formed on at least one of said side walls of said terminal part, said tab extending orthogonally away from said at least one of said side walls of said terminal part in a direction towards a respective other side wall of said terminal part, said tab defining a stop edge.

2. The contact spring assembly according to claim 1, wherein said bottom wall of said terminal part forms said extension of a side wall of said spring arm base, and one of said two side walls of said terminal part forms an extension of said bottom wall of said spring arm base.

3. The contact spring assembly according to claim 1, wherein said side walls of said terminal part have free edges, and said tab is formed on each of said free edges at an equal length thereof, each said tab projecting orthogonally away from a respective said side wall in a direction towards the other said side wall; said two tabs having a length such that upper and lower surfaces thereof are each flush with one another.

4. The contact spring assembly according to claim 1, wherein said side walls of said terminal part extend past said bottom wall of said terminal part thereof.

5. The contact spring assembly according to claim 1, wherein said detent device is a top spring fitted over said bottom spring at least at said spring arm base, said top spring being retained on said spring arm base, and said top spring having at least one detent tongue for primary locking.

6. The contact spring assembly according to claim 1, wherein said contact spring is one of a plurality of substantially identical contact springs arranged in a multiple-part flat conductor plug configuration, including a housing within which said contact springs are disposed side by side and one above the other in at least a first and a second row, said contact springs in said first row being rotated relative to said contact springs in said second row by substantially 180° such that said bottom walls of said spring arm bases of said first row of contact springs face toward said bottom walls of said contact springs of said second row.

7. The contact spring assembly according to claim 1, wherein at least one of said side walls of said spring arm base is approximately L-shaped, said at least one side wall having a height being greater toward said terminal part than in a remaining region of said spring arm base; and said at least one side wall having a raised portion with said tab formed thereon.

8. The contact spring assembly according to claim 7, wherein said at least one side wall of said spring arm base is substantially 1.2 to 2 times higher at said raised portion than in a remaining region of said at least one side walls.

9. The contact spring assembly according to claim 7, wherein each of said side walls is L-shaped, and each of said side walls carries a respective said raised portion, said tabs being formed on said raised portions.

10. The contact spring assembly according to claim 1, including a housing of said contact spring, said housing, in a region of said side walls of said terminal part carrying said insulation piercing connecting devices, including wall segments supporting said side walls of said terminal part except said insulation piercing connecting devices.

11. The contact spring assembly according to claim 10, said housing of said contact spring including further wall segments, and said at least one side wall of said spring arm base having a raised portion with a protruding tab formed thereon, said tab extending orthogonally away from said respective side wall of said spring arm base in a direction toward the other side wall of said spring arm base and defining a stop edge, and said further wall segments abutting said stop edge of said protruding tabs of said spring arm base.

12. The contact spring assembly according to claim 10, said housing of said contact spring including further wall segments, and including a tab formed on at least one of said side walls of said terminal part on a free edge thereof, said tab extending orthogonally away from said wall of said terminal part in a direction towards the respectively other side wall of said terminal part and defining a stop edge, said further wall segments abutting said stop edge of said tab of said terminal part.

13. The contact spring assembly according to claim 10, said housing of said contact spring including further wall segments, and including tabs formed on said side walls of said spring arm base and tabs formed on said side walls of said terminal part, each of said tabs extending orthogonally away from a respective said side wall of said spring arm base and of said terminal part in a direction towards the respectively other side wall of said spring arm base and of said terminal part and said tabs defining stop edges, and said further wall segments abutting said stop edges of said tabs of said spring arm base and of said terminal part.

* * * * *